US008104442B2

(12) United States Patent
Dorn et al.

(10) Patent No.: US 8,104,442 B2
(45) Date of Patent: Jan. 31, 2012

(54) MECHANICAL ROLLER TAPPET FOR AN INTERNAL COMBUSTION ENGINE

(75) Inventors: Stefan Dorn, Hollfeld (DE); Norbert Geyer, Höchstadt (DE); Manfred Jansen, Weisendorf (DE); Karsten Kucht, Wilhermsdorf (DE); Norbert Radinger, Nürnberg (DE)

(73) Assignee: Schaeffler KG, Herzogenaurach (DE)

( * ) Notice: Subject to any disclaimer, the term of this patent is extended or adjusted under 35 U.S.C. 154(b) by 354 days.

(21) Appl. No.: 12/449,341

(22) PCT Filed: Jan. 22, 2008

(86) PCT No.: PCT/EP2008/050714

§ 371 (c)(1),
(2), (4) Date: Aug. 3, 2009

(87) PCT Pub. No.: WO2008/095772

PCT Pub. Date: Aug. 14, 2008

(65) Prior Publication Data

US 2010/0012065 A1 Jan. 21, 2010

(30) Foreign Application Priority Data

Feb. 8, 2007 (DE) ..... 10 2007 006 320

(51) Int. Cl.
*F01L 1/14* (2006.01)

(52) U.S. Cl. ..... 123/90.48; 123/90.52

(58) Field of Classification Search ..... 123/90.48, 123/90.55, 90.52, 90.5
See application file for complete search history.

(56) References Cited

U.S. PATENT DOCUMENTS 5,676,098 A * 10/1997 Cecur ..... 123/90.5

FOREIGN PATENT DOCUMENTS

| | | | |
|---|---|---|---|
| CA | 2357794 | A1 | 2/2003 |
| DE | 1 806 336 | | 2/1960 |
| DE | 2220164 | | 4/1972 |
| DE | 41 28 813 | A1 | 3/1993 |
| DE | 4334517 | A1 | 4/1994 |
| DE | 197 29 793 | A1 | 1/1999 |
| DE | 19857376 | A1 | 6/2000 |
| DE | 10 2006 028348 | B3 | 10/2007 |
| EP | 0573674 | A1 | 12/1993 |
| EP | 1 273 771 | A1 | 1/2003 |
| GB | 2269210 | A | 7/1993 |
| JP | 01 1 10 871 | A | 4/1989 |
| JP | 10 018812 | A | 1/1998 |
| JP | 2003-1 84 699 | A | 7/2003 |

* cited by examiner

*Primary Examiner* — Zelalem Eshete
(74) *Attorney, Agent, or Firm* — Charles A. Muserlian

(57) ABSTRACT

A mechanical roller tappet (1*a*, 1*b*) comprising a tappet housing (2*a*, 2*b*) shaped out of sheet metal, a drive roller (3) actuable by a cam (9) and an axle (5*a*, 5*b*) on which the drive roller (3) is mounted, end portions (24) of the axle (5*a*, 5*b*) being supported in axle eyes (23) of the tappet housing (2*a*, 2*b*), said tappet housing (2*a*, 2*b*) comprising a tappet skirt (10*a*, 10*b*) and a tappet bottom (16) possessing a contact surface (21) for an adjacent engine component on a power take-off side and at an end of the tappet skirt facing the cam, the tappet bottom is connected to the tappet skirt and is shaped into the interior of the tappet skirt while forming a pocket for receiving the drive roller, the axle eyes being arranged in first sections (18) of the tappet bottom while being spaced from an inner peripheral surface (19) of the tappet skirt and extend substantially parallel to the longitudinal direction of the tappet skirt, the contact surface being arranged on a second section (20) of the tappet bottom connecting the first sections to each other.

12 Claims, 2 Drawing Sheets

MECHANICAL ROLLER TAPPET FOR AN INTERNAL COMBUSTION ENGINE

This application is a 371 of PCT/EP2008/050714 filed Jan. 22, 2008.

FIELD OF THE INVENTION

The invention concerns a mechanical roller tappet for an internal combustion engine, said roller tappet comprising a one-piece tappet housing shaped out of sheet metal, a drive roller actuable by a cam and an axle which mounts the drive roller centrally, optionally through rolling elements, end sections of the axle being supported in axle eyes of the tappet housing. The tappet housing comprises a tappet skirt which is mounted through an outer peripheral surface for longitudinal displacement in a tappet guide, and further comprises a tappet bottom possessing a contact surface for an adjacent engine component on a power take-off side.

BACKGROUND OF THE INVENTION

A roller tappet of the pre-cited type is disclosed in the document DE 100 44 732 A1 considered to be generic. The one-piece, shaped sheet metal tappet housing of the proposed roller tappet comprises a tappet skirt which, starting from a front-end tappet bottom, is configured with a semi-spherical contact surface for a tappet push rod through two or four upwards bent sheet metal strips. A drive roller arranged in an end section of the tappet skirt opposite the tappet bottom is rotatably mounted on an axle that is supported in two opposing sheet metal strips. Although this one-piece, shaped sheet metal tappet housing has a high light-weight and cost-saving potential, the structure of such a roller tappet has considerable inherent drawbacks. Among these is the fact that the sheet metal strips forming the tappet skirt have to be connected to one another through additional manufacturing steps after bending in order to guarantee the required shape rigidity and stability of the tappet housing. On the other hand, the introduction of supporting forces of the axle mounting the drive roller into the axle eyes, which are arranged directly in the tappet skirt, is to be seen as a critical factor in so far as, in comparison with a cast component or an extrusion molded component, tappet housings have much thinner walls possess, already in themselves, a comparatively low shape rigidity, so that even at the introduction of low supporting forces, there exists the risk of an impermissibly strong deformation of the tappet skirt with the result that the roller tappet can get jammed in the tappet guide.

OBJECT OF THE INVENTION

The object of the present invention is therefore to improve a roller tappet of the pre-cited type, so that the aforesaid drawbacks are eliminated by simple measures. The roller tappet should not only have a high light-weight and cost-saving potential, but, despite the fact of being made out of a sheet metal and despite the generally considerable supporting forces transmitted by the axle, should also comprise a tappet housing with the highest possible shape stability.

SUMMARY OF THE INVENTION

The invention achieves the above object by the fact that, at an end of the tappet skirt facing the cam, the tappet bottom is connected to the tappet skirt and is shaped into the interior of the tappet skirt while forming one of a pocket for receiving the drive roller or a strut engaging under the drive roller. The axle eyes are arranged in first sections of the tappet bottom, which first sections are spaced from an inner peripheral surface of the tappet skirt and extend substantially parallel to the longitudinal direction of the tappet skirt, the contact surface being arranged on a second section of the tappet bottom, which second section connects the first sections to each other.

Thus, motive forces introduced into the tappet housing through the drive roller and the axle are transmitted via a short force flow path that is substantially uncoupled from the tappet skirt, through the tappet bottom with the axle eyes arranged therein, to the adjacent engine component, while the tappet skirt mainly serves to support comparatively low transverse forces, so that, even with small wall thicknesses and/or high longitudinal motive forces, the tappet skirt can operate with sufficiently low deformation and, thus, free of jamming and with low friction in its tappet guide. This advantageous effect is further enhanced by the shape of the tappet bottom connected on the cam-side to the tappet skirt. Particularly in the case of the tappet bottom forming a pocket for the drive roller, the tappet bottom contributes to increasing the structural rigidity of the tappet housing. Because, further, the contact surface on the tappet bottom for the adjacent engine component extends near the drive roller on the power take-off side, the roller tappet can also have a very compact configuration with a correspondingly small installation dimension. As known, by installation dimension is to be understood the distance between the cam, or another component of the drive actuating the drive roller, and the adjacent engine component.

In a preferred development of the invention, the roller tappet serves for a lift actuation of a pump piston of a high pressure fuel pump, typically in a modern internal combustion engine with direct gasoline injection in which the cam is generally arranged on an end section of a camshaft that forms a part both of the gas exchange valve train and of the high pressure fuel pump. Alternatively, however, the roller tappet can also be used as a drive element for a gas exchange valve either in a so-called directly acting valve train, as known in connection with cup tappets having a sliding or a rolling contact with the cam, or in an indirectly acting tappet push rod valve train with a bottom camshaft. In the latter case, it is general practice to configure contact surface of the roller tappet on the power take-off side as a semi-spherical cavity corresponding to the spherical geometry of the front end of the tappet push rod.

In contrast to the roller tappet with flat tappet skirt sections known from the pre-cited prior art, the outer peripheral surface of the tappet skirt of the invention has an at least almost completely cylindrical configuration. Compared to non-cylindrical shapes, this configuration of the tappet skirt is particularly advantageous from a manufacturing point of view because the outer peripheral surface of the tappet skirt is substantially free of interruptions of the cylindrical shape, so that it is suitable for a grinding finishing and particularly for the more economic method of centerless machining.

According to a further feature of the invention, a correct orientation of the drive roller in the tappet guide is realized in a simple, precise and economic manner by the fact that the tappet skirt comprises a recess into which an anti-rotation body protruding radially beyond the outer peripheral surface of the tappet skirt is inserted.

According to a first alternative development of the invention, an axial fixation of the axle in the axle eyes is achieved by the fact that the axle comprises on one or on both end sections, a circumferential groove into which a locking ring is inserted. The locking ring or rings cooperate respectively with an outer surface of one of the first sections of the tappet bottom, which outer surface serves as an axial stop and faces the inner peripheral surface of the tappet skirt. If only one locking ring is used, this ring acts only in a first axial direction of the axle. For an axial fixing of the axle in the opposite, second axial direction, an axial end surface of the axle extending closest to the locking ring cooperates with an inner peripheral surface section of the tappet skirt serving as an axial stop. In this case, the tappet skirt comprises only one single mounting aperture for the axle, which mounting aperture is arranged diametrically opposite said inner peripheral surface section.

Independently of the number of such locking rings, this type of axial fixing of the axle enables an effective prevention of a shape distortion of the tappet housing caused already during assembly, for example, in the case of calked end sections of the axle due to introduction of radial forces into the axle eyes concomitant to a widening of the axle, particularly in thin-walled tappet housings. In the case of the invention, namely, axial fixation of the axle is effected solely by positive engagement by the fact that a movement of the axle in one or both axial directions is limited by the abutment of the locking ring or rings on the tappet bottom or, alternatively, in the second axial direction, by the inner peripheral surface section of the tappet skirt.

According to a second alternative development of the invention for the axial fixation of the axle in the axle eyes, a locking ring oriented crosswise to the longitudinal direction of the tappet skirt surrounds the first sections of the tappet bottom, bears against both axial end surfaces of the axle, at least alternately, and is supported secure against loss in longitudinal direction of the tappet skirt. While this type of axial fixation likewise offers the aforesaid advantages with regard to assembly-related shape distortion of the tappet housing, it also always permits additionally, the provision of two diametrically opposing mounting apertures for the axle in the tappet skirt, which mounting apertures are in axial alignment with the axle eyes. This can become necessary if the drive roller is mounted on the axle through a cageless set of needle rollers and, during mounting of the axle through one mounting aperture, the axle at the same time has to push a transportation safety plug, by which the set of needle rollers is fixed in the drive roller, out through the other mounting aperture.

According to another feature of the invention, an anti-loss support of the locking ring in longitudinal direction of the tappet skirt is achieved by the fact that the locking ring is supported on radially inwards extending projections on the inner peripheral surface of the tappet skirt. At least one of these projections has a knob-like configuration and is made preferably by a radially inwards stamping of the tappet skirt.

Moreover, the tappet housing can comprise at least one injection bore starting from a beadlike depression in the tappet skirt and extending crosswise to the axle while being directed to the drive roller for lubricating and cooling the drive roller. It can be advantageous in this connection if one of the projections on which the locking ring is supported is formed by this depression.

Finally it may be mentioned that the aforesaid embodiments of the invention can be combined at will with one another or also with other known features in so far as this is possible and appropriate.

BRIEF DESCRIPTION OF THE DRAWINGS

Further features of the invention will result from the following description and the appended drawings which show examples of embodiment of the invention. If not otherwise stated, identical or functionally identical components or features bear the same reference numerals.

DETAILED DESCRIPTION OF THE DRAWINGS

Figure 1A:
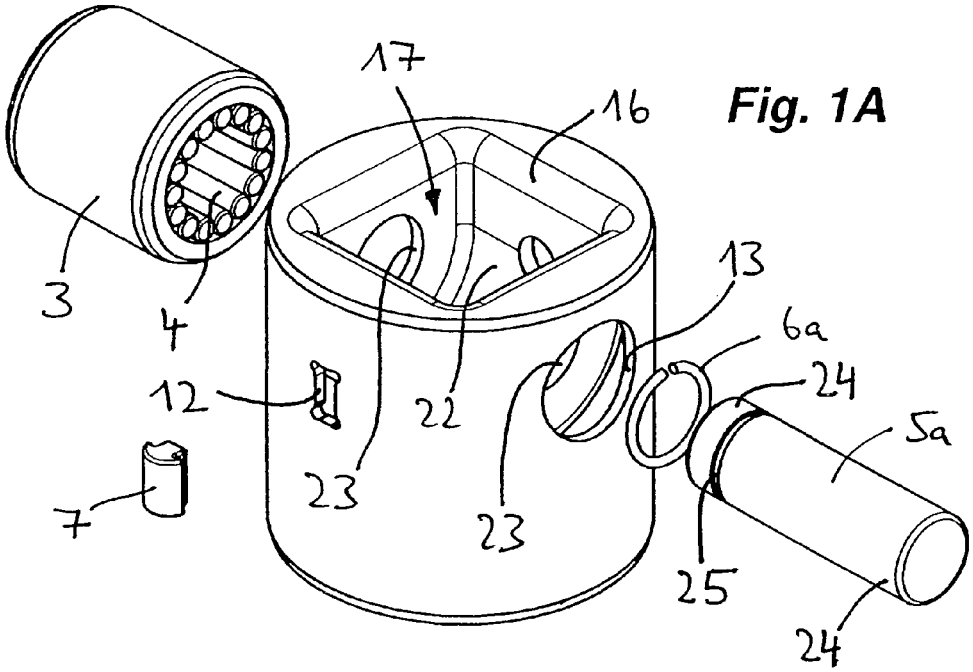
FIG. 1A shows a first example of embodiment of a roller tappet of the invention comprising a first alternative axial fixing of an axle, in an exploded, perspective illustration.
Figure 1B:
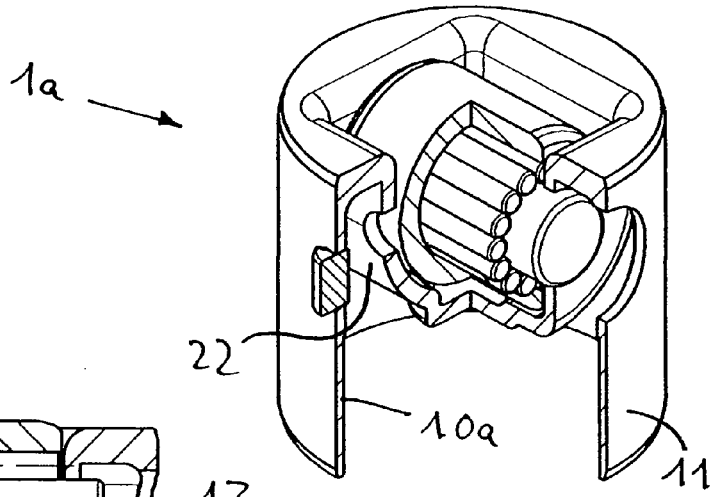
FIG. 1B shows the assembled roller tappet of FIG. 1A in a perspective, sectional representation.
Figure 1C:
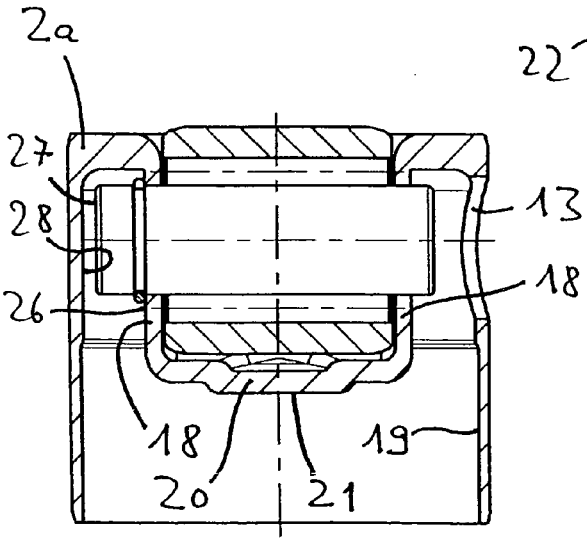
FIG. 1C shows the roller tappet of FIG. 1B in a longitudinal section.
Figure 2A:
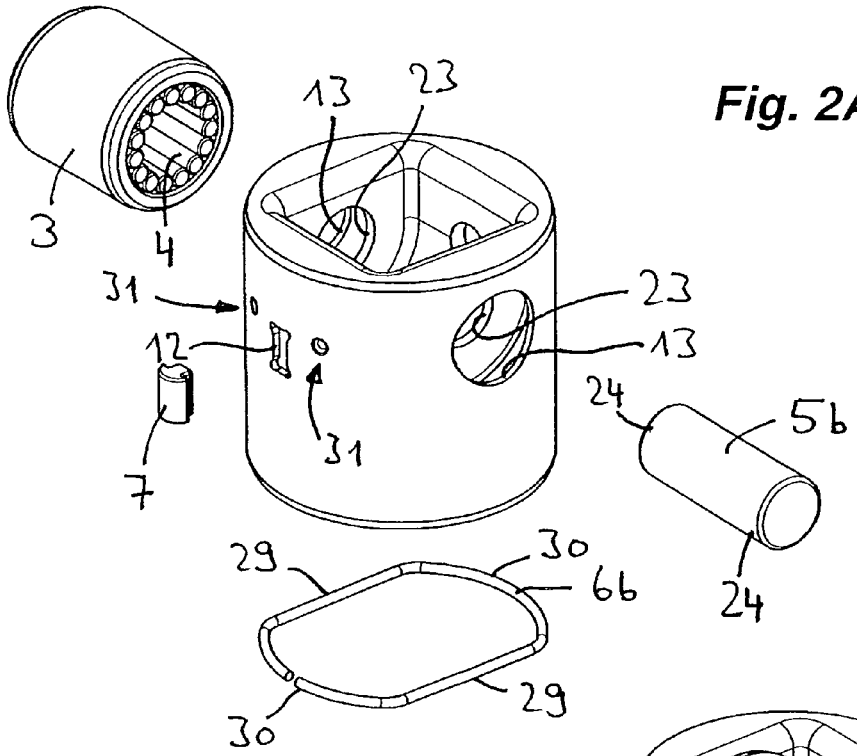
FIG. 2A shows a second example of embodiment of a roller tappet of the invention comprising a second alternative axial fixing of the axle, in an exploded, perspective illustration.
Figure 2B:
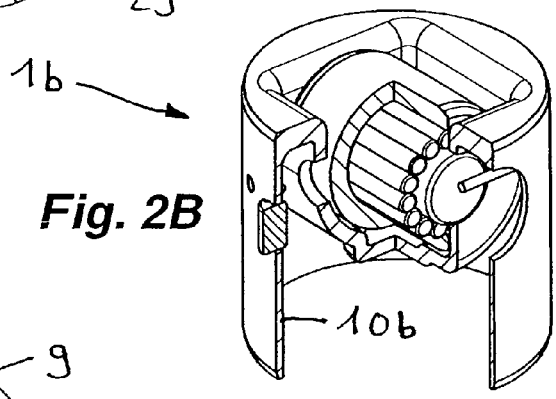
FIG. 2B shows the assembled roller tappet of FIG. 2A in a perspective, sectional representation.
Figure 2C:
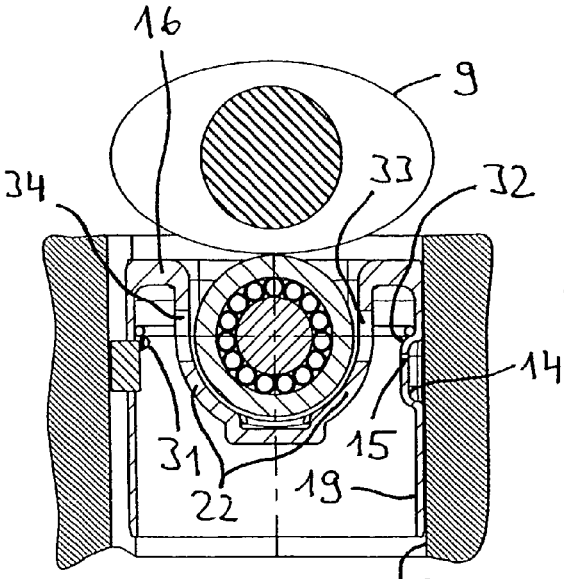
FIG. 2C shows the roller tappet of FIG. 2B in a longitudinal section, with cam and tappet guide.

FIGS. 1A-1C illustrate a mechanical roller tappet 1*a* for lift actuation of a pump piston, not shown, of a high pressure fuel pump of an internal combustion engine. The roller tappet 1*a* comprises a one-piece, thin-walled tappet housing 2*a* shaped out of a sheet metal, a drive roller 3, an axle 5*a* which mounts the drive roller 3*a* centrally through rolling elements 4 configured as needle rollers, a locking ring 6*a* for axially fixing the axle 5*a* in the tappet housing 2*a* and an anti-rotation body 7 for a radial alignment of the drive roller 3 in a tappet guide and also for a parallel alignment of the drive roller 3 to a cam applying a lift to the drive roller 3. The tappet guide identified at 8 and the cam identified at 9 are illustrated in FIG. 2C.

The tappet housing 2*a* comprises a tappet skirt 10*a* comprising an outer peripheral surface 11 mounted for longitudinal displacement in the tappet guide 8. The outer peripheral surface 11 has a completely cylindrical configuration but for a recess 12 for the anti-rotation body 7, a mounting aperture 13 for the axle 5*a* and an optional beadlike depression 14 comprising an injection bore 15, according to FIG. 2C, directed to the drive roller 3. A tappet bottom 16 connected to the tappet skirt 10*a* extends on an end of the tappet skirt 10*a* facing the cam 9. The tappet bottom 16 is shaped into the interior of the tappet skirt 10*a* and forms a pocket 17 which receives the drive roller 3. This pocket 17 in the roller tappet 1*a* and also in a roller tappet 2*a*, to be described later, is matched as far as possible to the cylindrical shape of the drive roller 3. The tappet bottom 16 comprises opposing first sections 18 which, in correspondence to the front end surfaces of the drive roller 3, have a flat configuration and extend spaced from the inner peripheral surface 19 of the tappet skirt 10*a* and substantially parallel to the longitudinal direction of the tappet skirt 10*a*. A contact surface 21 for an adjacent engine component, in this case a pump piston, extends on a power take-off side on a second section 20 of the tappet bottom 16 connecting the first sections 18. The closed shape of the pocket 17 results finally from opposing third sections 22 of the tappet bottom 16, the shape of which third sections in a cam-distal region is substantially matched to the cylindrical periphery of the drive roller 3. It can be seen further that, in the region of the contact surface 21, the second section 20 of the tappet bottom 16 is raised in direction of the pump piston and, additionally to the pocket 17, also contributes to the shape rigidity of the tappet bottom 16.

An alternative, not illustrated, to the closed pocket 17 is a tappet bottom which is shaped into the interior of the tappet skirt 10*a* while forming only a strut engaging under the drive roller 3. Such a strut would be formed, for example, by omitting the third sections 22 of the tappet bottom 16.

The shape stability of the tappet housing 2*a* required with regard to the cylindrical shape of the tappet skirt 10*a* is given through the fact that the axle 5*a* is supported in the axle eyes 23 that are not arranged directly in the tappet skirt 10*a* but in the first sections 18 of the tappet bottom 16 and are therefore uncoupled with an adequate radial distance from the outer peripheral surface 11 of the tappet skirt 10*a*. As a consequence, the force flow of the longitudinal motive forces to be transmitted from the roller tappet 1*a* to the pump piston is substantially uncoupled from the tappet skirt 10*a* because this is mainly loaded by comparatively small transversal motive forces. In addition, the thus obtained adequately stable cylindrical shape of the tappet skirt 10*a* is not or, at most, only insignificantly impaired by operation-related elastic deformations of the force-transmitting pocket 17 because it is only small deformations that are concerned here which, moreover, due to the structure of the tappet housing 2*a*, reach the tappet skirt 10*a* only in a weakened state.

Furthermore, a permanent deformation of the pocket 17 as would probably be caused by fixing the axle 5*a* in the axle eyes 23 in the case of an axle with calked front ends and radially widened end sections, is prevented through the positive engagement axial fixing of the axle 5*a* in the axle eyes 23. The axle 5*a* is mounted for axial displacement in the axle eyes 23 and comprises on one of its end sections 24, a circumferential groove 25 into which the locking ring 6*a* configured as a snap ring is inserted. Mounting of the locking ring 6*a* into the circumferential groove 25 is performed after the axle 5*a* has been passed through the mounting aperture 13 in the tappet skirt 10*a*, which mounting aperture 13 is aligned to the axle eyes 23. As can be seen very clearly in FIG. 1C, a movement of the axle 5*a* in a first axial direction is limited by the fact that the locking ring 6*a* cooperates with an outer surface 26 of the mounting aperture-distal first section 18 of the tappet bottom 16, which outer surface 26 serves as a stop. Conversely, the movement of the axle 5*a* in the opposite, second axial direction is limited by the fact that its axial end surface 27 situated nearest the circumferential groove 25 cooperates with an inner peripheral surface section 28 of the tappet skirt 10*a*, which section serves as a stop and is situated diametrically opposite the mounting aperture 13.

FIGS. 2A-2D show a roller tappet 1*b* as a second example of embodiment of the invention. This tappet differs from the previously described roller tappet 1*a* mainly through the configuration of the axial fixing of an axle 5*b* in the axle eyes 23. Similar to the case of the roller tappet 1*a*, the axle 5*b* inserted into the roller tappet 1*b* is supported axially displaceable through a small or, at most, moderate force application in the axle eyes 23. Axial fixing of the axle 5*b* in both axial directions is achieved in this case by a locking ring 6*b* which is oriented in a plane extending crosswise to the longitudinal direction of a tappet skirt 10*b*. The locking ring 6*b* comprises two opposing straight sections 29 which surround the first sections 18 of the tappet bottom 16 and bear against both axial end surfaces 27 of the axle 5*b*, and said locking ring 6*b* further comprises two arc-shaped sections 30 whose curvature is matched to the inner peripheral surface 19 of the tappet skirt 10*b*. For enabling assembly of the locking ring 6*b*, likewise configured as a snap ring, one of the arc-shaped sections 30 is split.

Figure 2D:
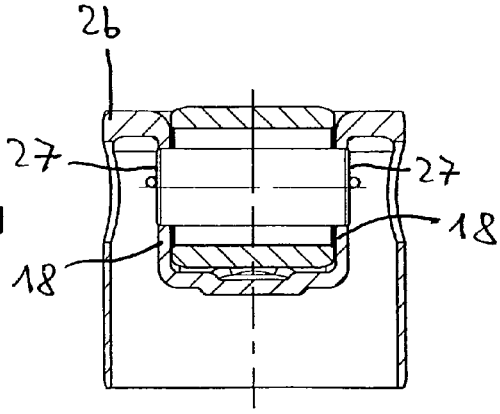
FIG. 2D shows the roller tappet of FIG. 2B in a longitudinal section turned through 90° relative to FIG. 2C.

As best seen in FIG. 2D, the locking ring 6*b* bears simultaneously against both axial end surfaces 27 of the axle 5*b*. An alternative configuration, not represented here, would be a locking ring whose straight sections 29 are spaced at a larger distance from each other than the length of the axle 5*b*, so that these sections 29 would bear only in alternation against the axial end surfaces 27 of the axle 5*b*. It is obvious that a condition for such a configuration is that the end sections 24 of the axle 5*b* cannot leave the axle eyes 23 either in the one or in the other axial direction of the axle 5*b*.

For an anti-loss support of the locking ring 6*b* in longitudinal direction of the roller tappet 1*b*, the inner peripheral surface 19 of the tappet skirt 10*b* comprises radially inwards extending projections 31 and 32 on which the locking ring 6*b* is supported. The projections 31 arranged on both sides of the recess 12 for the anti-loss body 7 are knob-shaped and made by radially inwards stamping of the tappet skirt 10*b*. The projection 32 is formed by the bead-like depression 14 from which the injection bore 15 extends crosswise to the axle 5*b* while being directed towards the drive roller 3. Pressurized lubricant from a lubricant channel, not illustrated, opening into the tappet guide 8, flows into the depression 14, then through the injection bore 15 and an aligned passage 33 arranged in one of the third sections 22 of the tappet bottom 16 and finally onto the peripheral surface of the drive roller 3 for lubricating and cooling the drive roller 3. This passage 33 and an optionally provided opposing passage 34 serve at the same time for a rapid ventilation of the cam-distal tappet space within the tappet guide 8.

The tappet skirt 10*b* of the roller tappet 1*b* further comprises two mounting apertures 13 for the axle 5*b*, which apertures 13 are situated diametrically opposite each other and aligned to the axle eyes 23. This can be necessary if, prior to the mounting of the drive roller 3 into the tappet housing 2*b*, the rolling elements 4 forming the needle roller set are fixed, centered through a transportation plug in the drive roller 3 and, during insertion of the axle 5*b* into the axle eyes 23, the transportation plug has to be pushed out through one of the mounting apertures 13. Depending on the width of such a transportation plug, which, if need be, can also be removed through the intermediate space between the first sections 18 of the tappet bottom 16 and the inner peripheral surface 19 of the tappet skirt 10*b*, or in the case of a drive roller that is only slide-mounted on the axle 5*b*, it is also possible to provide only one mounting aperture 13 as described in connection with the roller tappet 1*a*.

The invention claimed is:

1. A mechanical roller tappet for an internal combustion engine, said roller tappet comprising a one-piece tappet housing shaped out of a sheet metal, a drive roller actuable by a cam and an axle which mounts the drive roller centrally, optionally through rolling elements (4), end sections of the axle being supported in axle eyes of the tappet housing, said tappet housing comprising a tappet skirt which is mounted through an outer peripheral surface for longitudinal displacement in a tappet guide, and further comprising a tappet bottom possessing a contact surface for an adjacent engine component on a power take-off side, wherein, at an end of the tappet skirt facing the cam, the tappet bottom is connected to the tappet skirt and is shaped into the interior of the tappet skirt while forming one of a pocket for receiving the drive roller or a strut engaging under the drive roller, the axle eyes being arranged in first sections of the tappet bottom, which first sections are spaced from an inner peripheral surface of the tappet skirt and extend substantially parallel to a longitudinal direction of the tappet skirt, the contact surface being arranged on a second section of the tappet bottom, which second section connects the first sections to each other.

2. A roller tappet of claim 1, wherein the roller tappet serves for a lift actuation of a pump piston of a high pressure fuel pump.

3. A roller tappet of claim 1, wherein the outer peripheral surface of the tappet skirt has an at least almost completely cylindrical configuration.

4. A roller tappet of claim 1, wherein the tappet skirt comprises a recess into which an anti-rotation body protruding radially beyond the outer peripheral surface of the tappet skirt is inserted for realizing a radial orientation of the drive roller in the tappet guide.

5. A roller tappet of claim 1, wherein, for achieving an axial fixing of the axle in the axle eyes, the axle comprises on at least one end section, a circumferential groove into which a locking ring is inserted, which locking ring cooperates with an outer surface of one of the first sections of the tappet bottom and serves as an axial stop while facing the inner peripheral surface of the tappet skirt.

6. A roller tappet of claim 5, wherein the roller tappet comprises only one locking ring, acting in a first axial direction, while, in a second axial direction of the axle opposite to the first axial direction, an axial end surface of the axle extending closest to the locking ring cooperates with an inner peripheral surface section of the tappet skirt serving as an axial stop, the tappet skirt comprising a mounting aperture for the axle, which mounting aperture is situated diametrically opposite the inner peripheral surface section.

7. A roller tappet of claim 1 wherein, for an axial fixation of the axle in the axle eyes, a locking ring oriented crosswise to the longitudinal direction of the tappet skirt, surrounds the first sections of the tappet bottom, bears against both axial end surfaces of the axle, at least alternately, and is supported secure against loss in longitudinal direction of the tappet skirt.

8. A roller tappet of claim 7, wherein the locking ring is supported on radially inwards extending projections on the inner peripheral surface of the tappet skirt.

9. A roller tappet of claim 8, wherein at least one of the projections has a knob-like configuration and is made by a radially inwards stamping of the tappet skirt.

10. A roller tappet of claim 1, wherein the tappet skirt comprises two mounting apertures of the axle, which mounting apertures are situated diametrically opposite each other and are axially aligned the axle eyes.

11. A roller tappet of claim 1, wherein the tappet housing comprises at least one injection bore starting from a beadlike depression in the tappet skirt and extending crosswise to the axle while being directed to the drive roller.

12. A roller tappet of claims claim 8 wherein one of the projections is formed by the depression.

* * * * *